United States Patent [19]

Bettanini et al.

[11] 4,238,224

[45] Dec. 9, 1980

[54] CONTINUOUS EXTRACTION OF MAGNESIUM FROM MAGNESIUM OXIDES

[75] Inventors: Carlo Bettanini; Stelio Zanier; Margherita Enrici, all of Bolzano, Italy

[73] Assignee: Societa Italiana per Il Magnesesio E Leghe Di Magnesio S.p.A., Balzano, Italy

[21] Appl. No.: 51,970

[22] Filed: Jun. 25, 1979

[51] Int. Cl.[3] ..... C22B 45/00

[52] U.S. Cl. ..... 75/10 A; 75/67 R

[58] Field of Search ..... 75/67 R, 10 A

[56] References Cited

U.S. PATENT DOCUMENTS 2,148,358 2/1939 Lang et al. ..... 75/67 R 2,351,488 6/1944 Cooper ..... 75/67 R

*Primary Examiner*—M. J. Andrews

*Attorney, Agent, or Firm*—Larson, Taylor and Hinds

[57] ABSTRACT

A continuous process for extracting magnesium from compounds containing magnesium oxides is disclosed. In the past such processes have been batch type processes with oxides placed in a crucible of a furnace. The process comprises the steps of mixing magnesium oxide and an alkaline earth metal oxide with a reducing agent, compressing the mixture into briquettes, feeding the briquettes onto a conveying means, heating the briquettes uniformally on the conveying means under controlled pressure to vaporize the magnesium, and condensing the vaporized magnesium on a cooled surface.

6 Claims, 2 Drawing Figures

CONTINUOUS EXTRACTION OF MAGNESIUM FROM MAGNESIUM OXIDES

This invention relates to the continuous extraction of magnesium from magnesium oxides. More specifically, the invention relates to a process where magnesium oxides are mixed with at least one other alkaline earth metal oxide, and a reducing agent, and the mixture reduced on a continuous basis.

One of the main sources of magnesium metal produced on an industrial scale is dolomite which is a carbonate of calcium and magnesium. The magnesium metal is produced using a reduction process, and in the past silicon or ferro silicon has been the reducing agent. This process is known as the Pidgeon process. In the case where the startng material is calcined dolomite the following reaction occurs:

$$2(CaO.MgO)+Si=2Mg+(CaO)_2SiO_2$$

According to this process the magnesium metal is liberated from the intimate mixture in the vapour state leaving a bicalcium silicate as a dross.

In the past, this type of operation has been carried out by batch systems under a controlled pressure in a furnace. In some processes the mixture of oxides and a reducing agent are placed in a crucible or like container because the temperature used in the furnaces is sufficient to melt the mixture and thus steps must be taken to prevent the molten dross flowing over the floor of the furnace. However, when the composition is placed in a crucible it only leaves the top layer of the composition open to the controlled atmosphere in the furnace and thus vaporization can only occur from this top layer. Examples of these processes are described by Van Embden in U.S. Pat. No. 2,252,052, Cooper in U.S. Pat. No. 2,429,668 and Artru and Marchal in French Patent No. 762,671. Furthermore, with the high temperatures of the known processes of producing magnesium metal, a high degree of contamination occurs because, as well as magnesium, other metals are also vaporized and subsequently condensed in the reduction process. These other metals are present as impurities in the magnesium oxide, and include for example, calcium, lead, antimony, manganese, silicon, nickel, tin, copper, iron and others.

The problem of high temperatures can be overcome in part by making use of the silicothermic process in the solid state. Unlike known methods, this process does not require high temperatures, thus the dross does not become molten and can be extracted from the furnace in the solid state. By achieving this lower temperature, the degree of contamination is considerably reduced.

In one method, the silicon is replaced either in whole or in part with aluminum, the resulting reaction follows the following formula:

$$9MgO+5CaO+6Al=9Mg+(CaO)_5(Al_2O_3)_3$$

This process is carried out by first taking a measured amount of powdered aluminum, magnesium oxide and calcium oxide, mixing these powders together and compressing them into a block or briquettes for reduction by means of heating in a furnace under controlled pressure. The heating need not exceed 1100° C. and is preferably in the range of 800°–1100° C. Under these temperature conditions and at controlled pressure, the magnesium metal vaporizes and is recovered by condensation leaving behind an exhausted dross in the solid state consisting of a particular calcium aluminate or more generally a stoichiometric equivalent mixture of other aluminates.

The calcium oxide used in the above formula may be replaced by other alkaline earth metal oxides.

In the past, continuous processes have not been feasible due to the fact that the materials have had to be heated up to extreme temperatures and this has always been done in a closed furnace. It has now been found that partially due to an improvement in the availability of materials to withstand higher temperatures, and partially due to lower reaction temperatures, it is possible to carry out the process in a continuous manner. It has also been found that the greater magnesium content may be used in the starting mix, thus resulting in a higher output of magnesium from the same starting materials. Still further, by keeping the temperature below 1100° C. there is less wear on the equipment, which tends to keep operating maintenance costs down.

The present invention provides a continuous process of extracting magnesium from compounds containing magnesium oxides, comprising the steps of, mixing magnesium oxide and an alkaline earth metal oxide with a reducing agent, compressing the mixture into briquettes, feeding the briquettes onto a conveying means, heating the briquettes uniformally on the conveying means under controlled pressure to vaporize the magnesium, and condensing the vaporized magnesium on a cooled surface.

In a preferred embodiment the alkaline earth metal oxide is selected from the group consisting of calcium oxide. The reducing agent may be silicon or aluminum. In another preferred embodiment the mixture contains 2.0–2.5 parts by weight magnesium oxide, 1.5–2.0 parts by weight calcium oxide and 1.0–1.5 parts by weight aluminum, and the mixing occurs with the compounds in powder form. In other preferred embodiments, the controlled pressure is preferably maintained by an exhaust pump and the vaporized magnesium is condensed in at least one removable condensation chamber having a cooled surface therein. In one embodiment the briquettes are fed between moving belts are are heated by electrical resistance heating means, and the mixture is preferably heated to a temperature in the range of 800°–1100° C.

In drawings which illustrate an embodiment of the invention,

In a preferred embodiment of the invention magnesium oxide, calcium oxide and aluminum in powder or granule form are mixed together according to the following weight ratios, magnesium oxide 2.0–2.5 parts by weight, calcium oxide 1.5–2.0 parts by weight, aluminum 1.0–1.5 parts by weight. After mixing, these compounds are compacted and compressed into briquettes. The briquettes are sufficiently rigid that when left they retain their shape and do not collapse.

Figure 1:
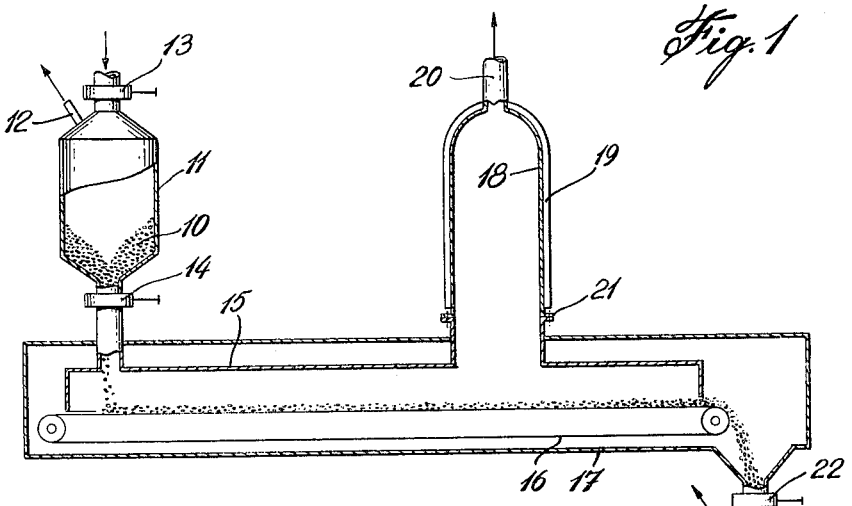
FIG. 1 shows a schematic elevational view of an apparatus for carrying out the process of the present invention.

Referring now to FIG. 1, the briquettes 10 are loaded into a mobile loading bin 11 which has a reduced pressure therein controlled through pipe 12. The loading bin 11 has a loading valve 13 which is open when loading the bin 11 and an outlet valve 14 for feeding the briquettes 10 into a reaction chamber 15. This reaction chamber 15 has electrical heaters therein which are not shown, and a conveyor 16 all of which are contained within a pressure vessel 17. A condensation chamber 18 is provided above the reaction chamber 15 having cooling elements 19 surrounding the outside surface and a pipe 20 feeding to an extraction pump. The condensation chamber 18 is joined to the pressure vessel 17 by a flange connection 21. The briquettes 10 fall off the end of the conveyor 16, pass through an exit valve 22 and into a mobile storage bin 23 which is similar to the loading bin 11 having a controlled pressure therein controlled through pipe 24 and an exit valve 25 at the base thereof.

In operation briquettes 10 are continuously fed from the loading bin 11 onto the conveyor 16. The outlet valve 14 remains open except when more briquettes 10 are fed into the bin 11 through the loading valve 13. The extraction of magnesium occurs as the briquettes 10 advance along the conveyor 16 and the magnesium vapour rises into the condensation chamber 18 where it condenses on the walls. When a layer of magnesium has been deposited on the internal walls of the condensation chamber 18, the process is shut down for a short period while the full condensation chamber 18 is removed and an empty chamber connected to the flange connection 21.

Figure 2:
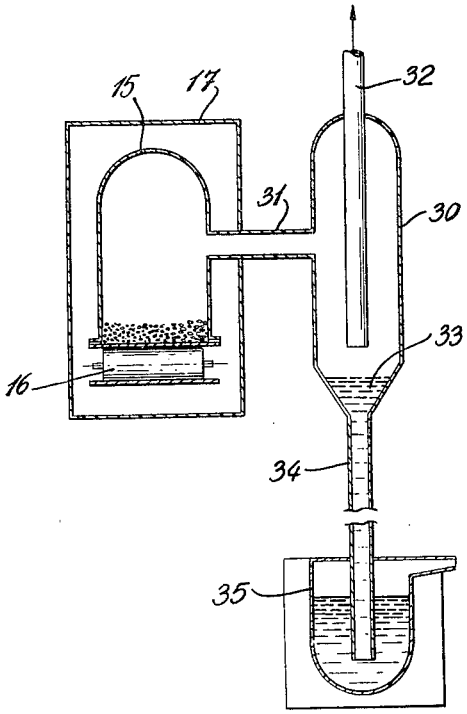
FIG. 2 shows a schematic cross sectional view of another type of apparatus for carrying out the process of the present invention.

FIG. 2 shows another embodiment wherein a condensation chamber 30 is joined to the reaction chamber 15 by a duct 31. An extracting pump is connected to an exhaust pipe 32, and external cooling is provided surrounding the condensation chamber 30. With controlled cooling and pressure within the condensation chamber 30 the magnesium 33 condenses in liquid state and collects at the bottom of the chamber 30 where a barometric column 34 approximately 7 meters long transfers the liquid magnesium in a continuous manner to a ladle 35 which is heated in a conventional furnace. The liquid metal is removed from the ladle 35 by conventional means, such as tipping.

In other embodiments the magnesium oxide is mixed with an alkaline earth metal oxide such as calcium oxide and the reducing agent is silicon instead of aluminum. The temperature inside the vessel is below the melting point of the dross so the briquettes do not form molten puddles in the chamber 15 and only the magnesium vaporizes and passes to the condensation chamber 18.

The process according to the present invention has the following advantages when compared with present day processes used in industry today or processes disclosed in prior art patents. The process is continuous which avoids time and energy losses during loading and unloading steps. The process has low reaction temperatures in the reaction chambers, and the temperature can be controlled to within 20° C. This provides energy savings because there is no overheating of the materials. Furthermore, product contamination is avoided due to the distillation of foreign metals having higher melting points. The operating cycle is simpler than previous process thus less man power required. All the reactions occur inside hermetically sealed equipment which avoids problems of pollution, and there is an improved operating efficiency over previously used processes because there is no need to heat and melt any other materials except those needed for the chemical reaction.

The embodiments of the invention in which an exclusive property or privilege is claimed are defined as follows:

1. A continuous process of extracting magnesium from compounds containing magnesium oxides, comprising the steps of:

mixing magnesium oxide and alkaline earth metal oxide with aluminum, compressing the mixture into briquettes, feeding the briquettes onto a conveying means, heating the briquettes uniformly to a temperature in the range of 800°–1100° C. on the conveying means under controlled pressure below atmospheric pressure to vaporize the magnesium, and condensing the vaporized magnesium on a cooled surface.

2. The process according to claim 1 wherein the alkaline earth metal oxide is calcium oxide.

3. The process according to claim 1 wherein the briquettes are fed between moving belts and are heated by electrical resistance heating means.

4. The process according to claim 1 wherein the mixture contains 2.0–2.5 parts by weight magnesium oxide, 1.5–2.0 parts by weight calcium oxide, and 1.0–1.5 parts by weight aluminum, and the mixing occurs with the compounds in powder form.

5. The process according to claim 1 or claim 4 wherein the controlled pressure is maintained by an exhaust pump.

6. The process according to claim 1 or claim 4 wherein the vaporized magnesium is condensed in at least one removable condensation chamber having the cooled surface therein.

* * * * *